United States Patent [19]

Marchiori et al.

[11] Patent Number: 4,862,687

[45] Date of Patent: Sep. 5, 1989

[54] SPINNING SYSTEM HAVING A ROTARY BALLOON CHECKING DEVICE

[75] Inventors: Mirko Marchiori, Pordenone; Fabio Lancerotto, Milan; Umberto Gerin, Pordenone, all of Italy

[73] Assignee: Cerit SpA, Pordenone, Italy

[21] Appl. No.: 222,546

[22] Filed: Jul. 21, 1988

[30] Foreign Application Priority Data

Aug. 10, 1987 [IT] Italy ..... 83437 A/87

[51] Int. Cl.[4] ..... D01H 7/18; D01H 7/66; D01H 13/04

[52] U.S. Cl. ..... 57/354; 57/67; 57/74; 57/352

[58] Field of Search ..... 57/67–72, 57/74, 124, 352, 354–357

[56] References Cited

U.S. PATENT DOCUMENTS 4,779,409 10/1988 Marchiori et al. ..... 57/67 X

FOREIGN PATENT DOCUMENTS 0225660 6/1987 European Pat. Off. .
967411 3/1950 France .
631753 8/1982 Switzerland .
631838 11/1949 United Kingdom .
782600 9/1957 United Kingdom .

*Primary Examiner*—John Petrakes

*Attorney, Agent, or Firm*—Wegner & Bretschneider

[57] ABSTRACT

Improvements to a spinning system (10) having a rotary balloon checking device (16), the checking device (16) consisting of an upper cylindrical portion (27) and lower frustum-shaped portion (28) which surround a yarn package (14) being formed, the upper portion (27) being upheld by a support (17) with bearings which is solidly fixed to a rail (19) of a spinning machine, the yarn (22) on arrival from a drafting unit (20) of the spinning machine forming a balloon between a thread eye (21) and the top of the checking device (16) and thereafter constituting an inner controlled segment (125) and an outer segment (225) able to slide on the checking device (16) during its descent to be wound on the yarn package (14), the yarn (22) being guided (29) at the lower edge of the frustum-shaped portion (28), the improvements comprising:

the outer slidable segment (225) of yarn positioned in correspondence with the upper part of the upper cylindrical portion (27) of the checking device (16), and an element (31) to guide the yarn (22) towards the yarn package (14) in correspondence with the lower end part of the frustum-shaped portion (28) of the checking device (16), such guide element (31) being located on the inner surface of the lower end part of the frustum-shaped portion (28).

11 Claims, 2 Drawing Sheets

SPINNING SYSTEM HAVING A ROTARY BALLOON CHECKING DEVICE

This invention concerns improvements to a spinning system having a rotary balloon checking device. To be more exact, the invention concerns a segment of yarn able to slide on the rotary balloon checking device and also a type of attachment for the yarn on the checking device that will guide the yarn being wound onto the yarn package.

The improvements according to the invention ensure better performance of spinning and twisting machines employing the system having a rotary balloon checking device and better operating conditions for the operatives in charge of such spinning and twisting machines.

Spinning systems with a rotary balloon checking device are known in the art.

The system employed in the embodiment disclosed in U.S. Pat. No. 4,779,409 provides a rotary balloon checking device which makes possible, starting with the winding tension, the predetermined of the reduction of that tension to the require value on the basis of the balloon.

Such reduced tension, which coincides with the spinning tension, is normally obtained by choosing a suitable extent of surface for the sliding of the yarn on the outside of the lower frustum-shaped portion of the rotary checking device.

The yarn, which is this case is in the upper cylindrical portion of the checking device, is merely guided by the inner surface of the upper portion or is guided by means of a tube or conduit.

At a given point the yarn comes out from the upper cylindrical portion onto the outer surface of the device and is made to slide along a given extent of surface on the frustum-shaped portion of the checking device.

The yarn leaves the lower edge of the checking device and is wound onto the yarn package by passing through a hole or appropriate lead-in in the checking device.

In any event the yarn is guided in the last controlling part of the checking device before leaving the device and being wound onto the yarn package.

Some shortcomings are entailed in the configuration described in the '409 Patent.

First of all, the re-ascent of the twist from the point or zone in which it is imparted to the yarn, up to the drafting unit, encounters some hindrances. As the twist is imparted in the sliding stretch on the outer surface of the checking device and as the yarn is thrust against that surface, the twist in its re-ascent towards the drafting unit is hindered in the upper cylindrical portion of the device, against the inner surface of which the yarn is thrust by the forces in question. Moreover, such hindrance varies since the contact between the yarn and the controlling surface varies from moment to moment owing to the unavoidable geometric variations in the balloon due to the pulsations of the tension.

It is known that, in spinning or twisting operations, the fact that the twist can re-ascend in a continuous, uniform manner is of great technological importance.

A further drawback consists of the fact that the rotation of the checking device by the spindle takes place by means of a very short length of yarn which is free in the air, particularly at the moment when it is wound on the outer diameter of the yarn package.

Another shortcoming is the fact that the yarn is rigidly engaged at the edge of the checking device by a hole or notch through which it passes. This does not allow the yarn to react resiliently, except to a very limited extent, to any irregularity in the spinning conditions, such as any irregularity in the motion of the spindle or any geometric irregularity in the yarn package or any of the many other possible irregularities.

The outcome may be an increase in the number of breakages of the yarn or a deterioration of the quality of the yarn.

Document FR 967.411 deals with a shell or sheath like a bell, which comprises on the lower end portion of its inner surface a thread guide conformed structurally so as to enable the yarn to pass from above downwards along the inner wall of the shell towards the thread guide device. This definition has been inferred from FIG. 1 and from the abstract included in the document since in that document there are no other points where there is a specific mention of the functional characteristics of the thread guide. The thread guide diverts the yarn with one single position of location of the yarn at work and therefore tends to solve different problems from those with which our present invention is concerned.

Document CH 631.753 deals with a roving-clamping device which can be actuated, when the yarn breaks, crosswise to the direction of feed of the roving in the area of entry into the feed rollers of the drafting unit, as set forth in the main claim. This device obtains a lateral diversion of the roving with a gripping of the same when the roving breaks, that is to say, the device takes action when the roving breaks, and this is in conditions different from our invention.

The present applicant has studied, tested and obtained improvements to a spinning system having a rotary balloon checking device which are able to overcome all the shortcomings of the known art.

According to the invention, the extent of surface on which the yarn slides on the checking device, such extent being suitable to pre-determine the required spinning tension, is located in correspondence with the upper part of the cylindrical portion of the checking device above the support which upholds the device itself.

The length of the extent of surface on which the yarn slides can be varied and pre-set.

According to the invention the yarn descends within the device from the cylindrical portion until it reaches an element which guides it towards the yarn package. In the end part of its descent of the frustum-shaped portion of the device, the yarn descends separated from the inner surface of that zone. This is obtained by the inclusion of the guide element, of which the conformation and arrangement on the device are also such as to allow displacement of the guiding point on a given segment during the spinning, so as to take account of the unavoidable disturbances which take place during the spinning cycle. In other words, the configuration of the guide has the effect that the point at which the yarn is guided towards the yarn package is not a stationary point but can be suitably varied within a given field, depending on the geometric conformation of the guide element. Thus, the yarn is in unstable equilibrium and can react readily to any variation, even if momentary, in the spinning conditions.

The guide element is suitably conformed for swift insertion of the yarn during the operations of the spinning cycle.

The improvements according to the invention entail a plurality of advantages as follows:

- the twist is imparted to the yarn at a position corresponding to the outer sliding segment very near the drafting unit, and therefore the length of the re-ascent of the twist is very short,
- in practice the twist re-ascends along an extent of yarn free in the air without hindrances or points of resistance, this extent corresponding substantially with the distance between the drafting unit and the upper terminal edge of the rotary checking device,
- the re-ascent of the twist takes place in a segment of yarn subject to a tension less than the value of the winding tension,
- the descending segment of yarn within the checking device towards the guide element is already fully twisted and is therefore less liable to damage by sliding on the inner surface of the wall of the checking device,
- the descending segment of the yarn within the checking device possesses a high tension substantially equal to that of the yarn as wound on the yarn package, this tension opposing the centrifugal force to prevent the yarn from being strongly thrust against the inner wall of the checking device in the first descent segment thereby enabling the yarn to remain separated from the wall of the checking device in the final descent segment,
- the configuration of the guide element makes it possible to have a segment of yarn free in the air upstream of the guide element, the freedom of this segment and the final winding segment allowing dampening of the points of tension on the yarn arising from working irregularities,
- the yarn can be displaced on the guide element and can thus absorb variations, even if momentary, in the tension due to functioning irregularities,
- the wear on the guide element is considerably reduced by continuous variations in the point of its contact with the yarn, and
- the above improvements enable the yarn to be readily inserted, since the yarn can be passed freely through the whole checking device upwards from below, for instance by pneumatic propulsion of the end of the yarn.

The attached figures, which are given as a non-restrictive example, show the following:

Figure 3:
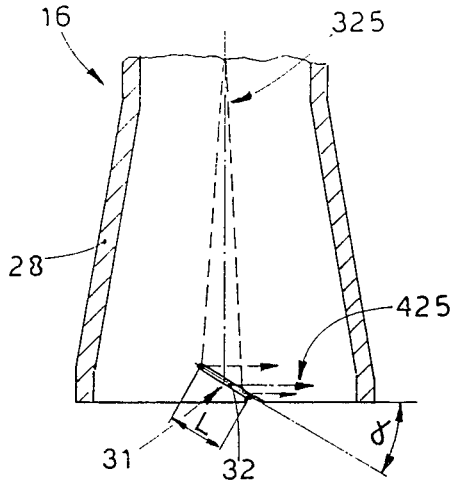
FIG. 3 shows diagrammatically a front vertical section of the lower part of the checking device together with a guide element according to the invention.
Figure 4:
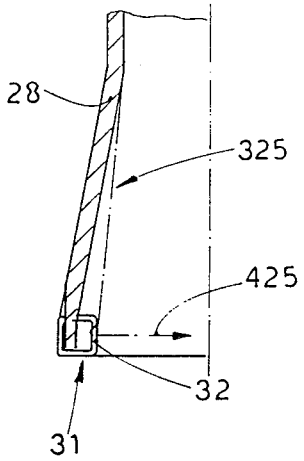
Figure 5:
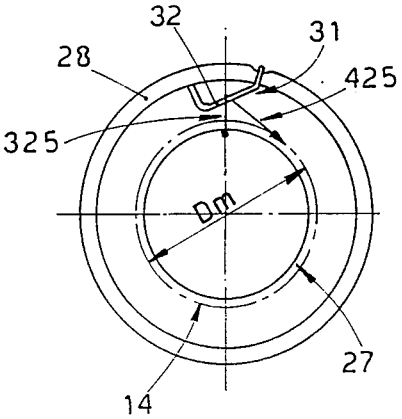
Figure 6:
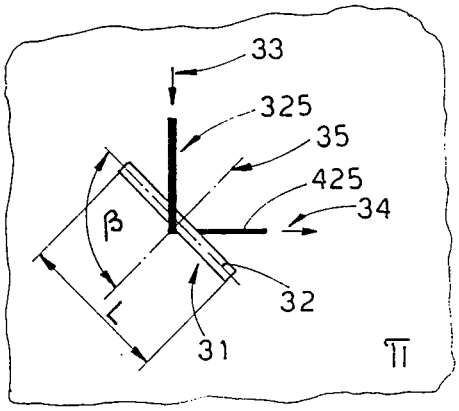

FIG. 4 gives a side view of FIG. 3;

FIG. 5 shows a diagram of the checking device of the invention from below;

FIG. 6 gives a diagram of a guide element and guiding conditions according to the invention.

Figure 1:
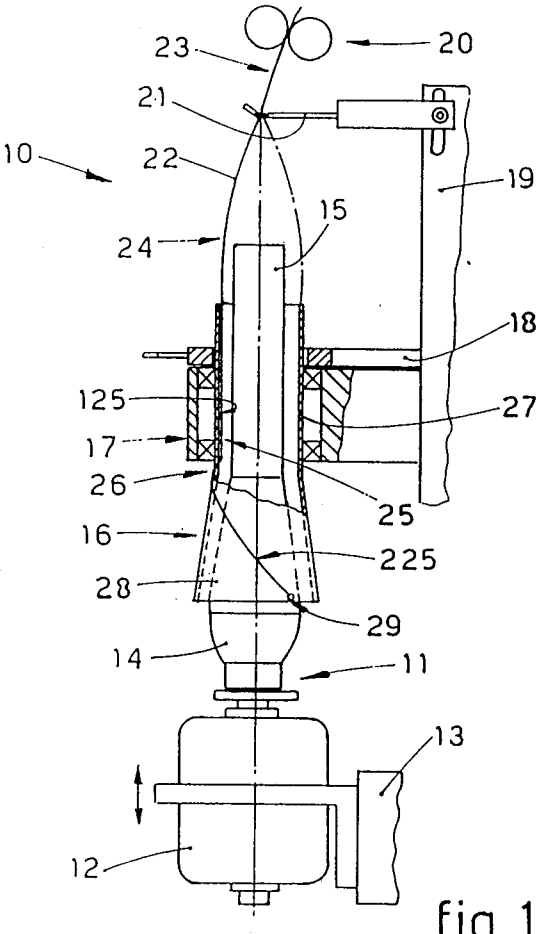
FIG. 1 shows an embodiment of the prior art.

FIG. 1 shows an embodiment of the prior art; a spinning system 10 is applied to a spindle 11 which in this example is driven by an independent motor 12 fitted to a rail 13 energized by vertical reciprocating motion, indicated by the arrow, so as to form a yarn package 14 on a tube 15.

A balloon checking device 16 consists of an upper cylindrical portion 27 and a lower frustum-shaped portion or distributor portion 28.

The checking device 16 surrounds the yarn package 14 being formed and lets the top of the tube 15 protrude upwards.

The cylindrical portion 27 is upheld by a support 17 with bearings solidly fixed to a rail 19 of the spinning machine, the rail being stationary in this example.

A brake 18, of a magnetic type for instance, serves to graduate the winding tension in a known manner.

Yarn 22 arriving from a drafting unit 20 constitutes a first segment 23 which reaches a thread eye 21. A second segement 24 of yarn forms a balloon between the thread eye 21 and the upper end of the checking device 16.

After entering the device 16, the yarn constitutes a controlled extent 25, of which a first segment 125 is within the device 16 while a second segment 225 forms the outer segment of yarn sliding on the frustum-shaped portion 28. The yarn 22 emerges from the cylindrical portion 27 through a hole 26.

The yarn 22 is guided in a lead-in 29 comprised in the lower edge of the frustum-shaped portion 28 and is then wound onto the yarn package 14.

Figure 2:
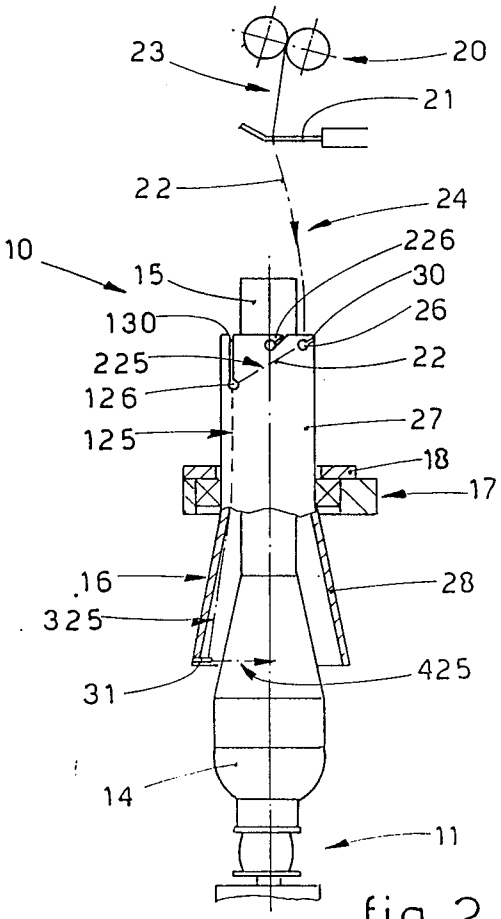
FIG. 2 shows an embodiment according to the invention.

FIG. 2 shows an embodiment according to the invention in which the same parts or parts having the same functions bear the same reference numbers as in FIG. 1.

The yarn 22 arrives at the top of the checking device 16 from the drafting unit 20 as in the prior art. It enters into the inside of the cylindrical portion 27 at the top of the device and runs therein for a short distance; it emerges through the hole 26 and, after forming a sliding segment 225 on the outer surface of the cylindrical portion 27, re-enters that portion 27 through a second hole 126.

Notches 30 and 130 are formed in the cylindrical portion 27 for the introduction of the yarn 22 into the holes 26 and 126 respectively.

A third hole 226 is also formed in the same zone so as to pre-determine a different length of sliding segment 225.

A plurality of holes 26-126-226 can be included to obtain different combinations of sliding segments 225 as required.

The yarn 22 proceeds inside the cylindrical portion 27 along a controlled segment 125 in which it is in contact with the inner surface of that portion 27.

It then proceeds within the frustum-shaped portion 28 of the device 16 along a segment 325 substantially separated from the inner surface of the frustum-shaped portion 28.

The separated segment 325 of yarn cooperates at its lower end with a guide element 31, which may be a hook or the like for instance, so as to form a free segment 425 of yarn for winding on the yarn package 14.

The guide element 31, which is fixed suitably to the inner, lower end part (see FIGS. 3, 4, 5 and 6) of the frustum-shaped portion 28, comprises a substantially straight part 22 or a part having a very slight curvature. This part 32 enables the segments 325 and 425 of the yarn to move freely, as shown with dashes in FIG. 3.

Such straight part 32 of the guide element may have a length "L" advantageously, but not only, within a range between 3 and 15 mm. This straight part 32 is inclined at an angle "gamma", which is advantageously about 45°, to the plane of the lower edge of the frustum-shaped portion 28, such angle enabling the guiding point of the yarn and the yarn segments 325 and 425 to to be displaced in response to spinning irregularities.

The substantially straight part 32 lies on a plane "pi" identified by the direction of arrival (arrow 32) of the separated segment 325 on the straight part 32 and by the direction of departure (arrow 34) of the free segment 425 of the yarn 32 from the straight part 32.

The straight part 32 will advantageously be at about a right angle (angle "beta" of about 90° in FIG. 6) to the bisector 35 of the angle formed by the direction of arrival 33 and of departure 34 of the yarn 22 on the straight part 32, in correspondence with a mean diameter "Dm" of the yarn package 14.

We claim:

1. A spinning system, said system comprising:

a drafting unit;

a thread eye;

a rotary checking device positioned about a yarn package, said checking device being set in rotation on a spindle by the yarn, said checking device having an upper cylindrical portion supported at its lower end by a support and having a lower frustum-shaped portion having a guide element fixed to a lower terminal edge thereof;

a first free end segment of yarn between said drafting unit and said thread eye;

a free segment of yarn downstream of said first free segment, said free segment forming a balloon, the height and base diameter of said balloon being controlled and maintained substantially constant by said checking device;

a last free segment of yarn downstream of said free segment between said checking device and said yarn package; and a guided segment of yarn downstream of said free segment and upstream of said last free end segment, said guided segment having an outer sliding segment located in correspondence with a portion of said cylindrical portion, said guided segment also having a segment displacable on a predetermined part of said guide element.

2. A system as in claim 1, wherein said checking device has at least two holes permitting passage of yarn in desired positions on the upper cylindrical portion so as to form said outer sliding segment.

3. A system as in claim 2, wherein said cylindrical portion has notches for facilitating swift insertion of the yarn in said at least two holes.

4. A system as in claim 1, wherein said guide element is hook-shaped having a substantially straight portion forming said predetermined part on which a guiding point for the yarn can move freely.

5. A system as in claim 4, wherein said substantially straight portion is spaced from an inner wall of said frustum-shaped portion.

6. A system as in claim 5, wherein said substantially straight portion has a length approximately between 3 and 15 mm.

7. A system as in claim 6, wherein said substantially straight portion is inclined at an angle with respect to the plane of said lower terminal edge.

8. A system as in claim 7, wherein said angle is approximately 45 degrees.

9. A system as in claim 4, wherein said substantially straight portion is disposed in a plane defined by a direction of arrival of said yarn to said substantially straight portion and a direction of departure of said yarn from said substantially straight portion.

10. A system as in claim 9, wherein said substantially straight portion is disposed approximately 90 degrees to the bisector of the angle formed between said direction of arrival and said direction of departure in correspondence with a mean diameter of said yarn package.

11. A system as in claim 1, wherein said guide element comprises an interruption on one side of said checking device for introduction of the yarn.

* * * * *